United States Patent [19]

Long

[11] 4,185,811

[45] Jan. 29, 1980

[54] ONE HAND HELD AND OPERATED CLAMP

[76] Inventor: Howard W. Long, 1823 Sunrise Dr., Anchorage, Ak. 99504

[21] Appl. No.: 901,345

[22] Filed: May 1, 1978

[51] Int. Cl.[2] ..... B66F 3/00

[52] U.S. Cl. ..... 269/6; 269/95; 269/216

[58] Field of Search ..... 269/3, 4, 6, 95, 99–101, 269/143, 150, 198, 201, 228, 216; 81/129, 152

[56] References Cited

U.S. PATENT DOCUMENTS

| | | | |
|---|---|---|---|
| 823,149 | 6/1906 | White | 269/150 |
| 893,982 | 7/1908 | Chase | 254/70 |
| 2,472,658 | 6/1949 | Gilbert | 269/198 |
| 3,224,752 | 12/1965 | Benbow | 269/6 |
| 3,492,854 | 2/1970 | Eppler | 254/106 |
| 3,836,136 | 9/1974 | Davis | 269/201 |
| 4,032,109 | 6/1977 | Wilson | 254/69 |

*Primary Examiner*—Robert C. Watson
*Attorney, Agent, or Firm*—William B. Walter

[57] ABSTRACT

A clamping mechanism for C-clamps, wrenches, vises and other work holding equipment has a detent as a means to hold the jaws open in a work receiving position with the moveable jaw free of the fixed jaw; a spring or weight bias with dash pot for gentle slow closing bringing the moveable jaw against the work as the work is held against the fixed jaw; a reciprocable manually operated one-way clutch mechanism having a drive and return stroke acting on a sliding plunger supporting the moveable jaw to apply added clamping force on the work between the fixed and moveable jaws; a second one-way clutch engaged with the clamp frame acting on the moveable jaw plunger to hold the moveable jaw in clamping position when the manually operated one-way clutch is in the return stroke and thus not holding the plunger; and a clamp release mechanism which releases the two one-way clutches thus allowing the clamp to be opened against the force of the moveable jaw bias only. The actuator for the manually operated one-way clutch is a reciprocating lever arranged to be gripped and operated by the hand holding the clamping device. The clamp release control is a push-button which is so placed on the clamp frame that it may be operated by the thumb of the hand holding the clamp. When the release button has been depressed, the clamp is released from the work by pushing down on the clamp to retract the moveable jaw. The detent then holds the jaws open.

9 Claims, 17 Drawing Figures

ONE HAND HELD AND OPERATED CLAMP

BACKGROUND OF THE INVENTION

The invention relates to clamps for welding, glueing, etc. in particular, but has application to wrenches, vises and other workholding equipment as well. In the use of welding clamps holding a multitude of metal pieces together in the position desired for permanent attachment by welding, it is often necessary to hold such pieces together against the force of gravity, and as the clamp is tightened, the spring of the pieces and the rotation of the screw will create forces to change their relative positions. The clamps used are variations of C-clamps in which a moveable jaw is forced towards a fixed jaw by a screw jack turned by hand. In such an operation, one hand is needed to hold the body of the clamp, one hand for turning the screw, and a third hand is needed to hold the work in place.

Improvisations using a knee, a jury rig lever temporarily welded to the work or work table, etc. are not only inadequate to take the place of the third hand, but are sometimes hazardous, time-consuming and poor substitutes for the third hand for holding the work in place. Thus there is a need for a one-hand operated welding clamp leaving the welder's other hand free to position the work and hold it in place until held in place firmly by the clamp.

A one-hand operated C-clamp is shown in Gilbert U.S. Pat. No. 2,472,658 having a rack-held moveable jaw which is dropped down against the work by gravity, and a lever and cam-operated pawl which is then engaged with the rack by a hand-squeeze handle to increase clamping pressure, locking it in that position in one stroke of the hand-squeeze handle. If the clamping movement is insufficient to properly clamp the work, a screw jack in the jaw head is rotated to adjust the jaw so that proper holding pressure is obtained. Since proper holding or clamping pressure may not always be obtained without use of the screw jack, on hand is needed to hold the clamp, a second to hold the work, and a third to operate the screw jack.

Cartridge dispensing caulking guns of conventional contemporary design such as Darworth Company of Avon, Connecticut Form No. CP-SS-276 use a hand-squeeze lever operated pawl and ratchet to advance the caulking gun piston with a second pawl engaging the ratchet teeth on the piston shaft to hold the piston between power strokes. The piston is released by the operator's other hand rotating the piston shaft thus lifting both pawls out of engagement with the ratchet teeth which are on only one side of the shaft. While such a mechanism has application to clamps, etc., it is limited because of its ratchet action with only fixed increments of closing motion and need for two hand operation for quick closing and release.

U.S. Pat. Nos. 2,967,445 (Chase) and 2,985,048 (DeHart) show vises in which a screw jack can be operated by a foot pedal. U.S. Pat. Nos. 1,460,294 (Wegner) and 2,321,911 (Heaton) show wrenches in which the last stage of closing or clamping is accomplished by lever action.

BRIEF SUMMARY OF THE INVENTION

The primary object of this invention is to provide a clamp which can be held and operated by one hand for a. clamping, b. tripping a clamp release and c. fully opening the clamp with the clamp locked open and thus ready for the next operation.

Another object of this invention is to provide a clamp, held and operated by one hand, which can be instantly opened fully by the hand holding the clamp. p Another object of this invention is to provide a clamp, held and operated by one hand, which can be gently closed into work contacting position at a regulated speed by a single squeeze of a hand squeeze lever.

Another object of this invention is to provide a clamp, held and operated by one hand, which when in work contacting position, can be tightened on the work for the required clamping with an infinitely variable displacement of the moveable jaw by a partial stroke or a series of strokes of a hand squeeze lever.

It is another object of this invention to provide a clamp, held and operated by one hand, which will not cause any side thrust on the clamped members.

This invention is a clamp with piston grip and squeeze lever operating a pair of one-way clutches, one of which successively engages the shaft of a work-clamping jaw with each hand squeeze to advance the jaw in short high leverage strokes with the other one-way clutch locking the jaw shaft while the hand squeeze lever is returned by spring for another power stroke. Both one-way clutches can be advanced in infinitely small steps, thus making possible a high clamping force with no relieving of that force to back down to a locking position. A push-button operated clutch release mechanism, accessible to the thumb of the hand holding the clamp, is used to release the clamping pressure, a detent to hold the clamp jaw shaft retracted to receive the work, and a dashpot and spring on the shaft housing to initially advance the jaw towards the work slowly.

DETAILED DESCRIPTION OF THE INVENTION

Figure 1:
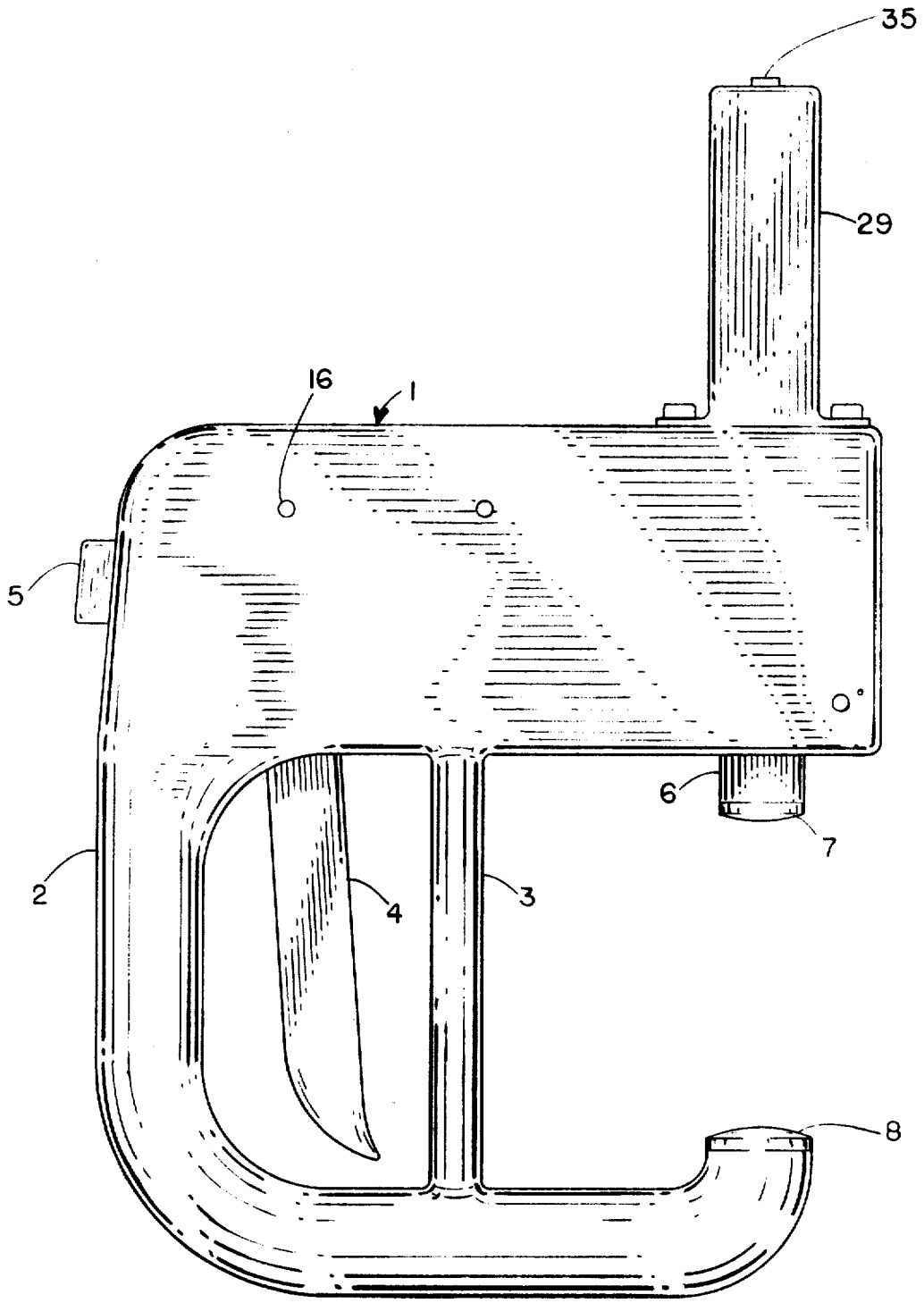
FIG. 1 is an elevation of a preferred embodiment of the clamp of my invention.

A preferred embodiment of my clamp is seen in FIGS. 1-9. The frame of my clamp, in contrast to those of other C-clamps, is a housing 1 for the operating mechanisms. The housing 1 includes a hand grip 2 and a housing tie member 3. The housing tie member 3 strengthens the housing 1 and guards the users fingers when wrapped around the hand grip 2 and hand squeeze lever 4. The hand squeeze lever 4 and clutch release button 5 are the two clamp control units. A shaft 6 which is square in cross section in this embodiment is slidably mounted in a bore in the clamp housing 1 and is biased by closing spring 28 to urge a moveable work holding jaw 7 towards the fixed work holding jaw 8 on the lower arm of clamp housing 1.

A manually operating shaft actuation means in the housing 1 serves to drive the moveable work holding jaw 7 towards the fixed work holding jaw 8 with a clamping force as required. This shaft actuation means comprises a one-way drive clutch 13 operated through linkage by the hand squeeze lever 4, and a shaft holding one-way clutch 23.

Figure 2:
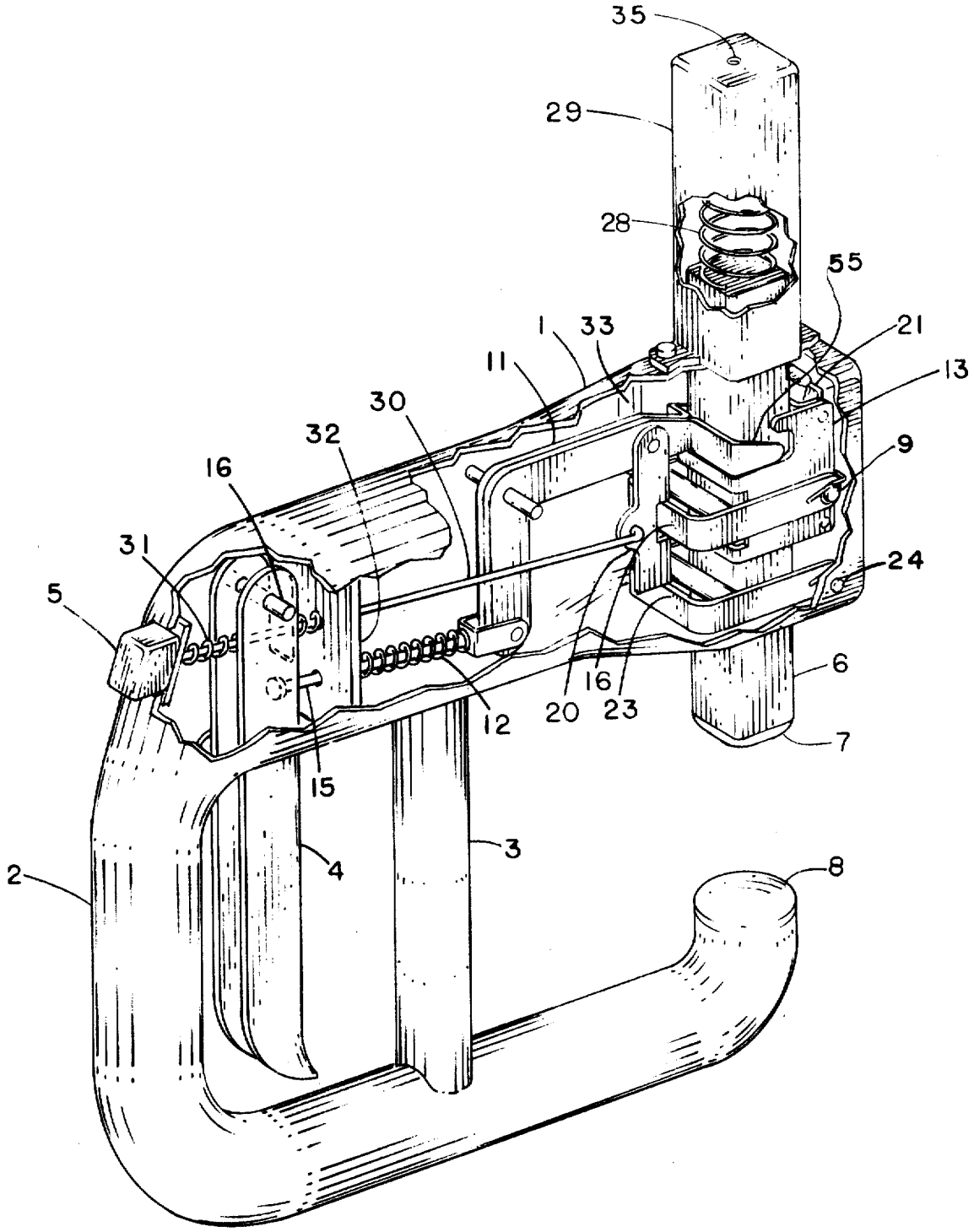
FIG. 2 is a perspective of the clamp of FIG. 1 with a portion of the side of the clamp casing cut away to show the working parts of the clamp mechanism.

As best seen in FIG. 2, the hand squeeze lever 4 is connected to the one-way drive clutch 13 by a tension rod 15 and bell-crank 11 with leverage providing a short strong driving stroke on the shaft 6. In the normal released position of the hand squeeze lever 4, the bell crank 11 is rotated counter-clockwise by a crank-return compression spring 12, as seen in FIG. 2, to raise the one-way drive clutch 13 as in FIG. 5.

One-Way Drive Clutch

The one-way drive clutch 13 comprises the following:

a. A square, in this embodiment, tubular sleeve 13 having a pair of sockets 14 with which the forked end 55 of the bell-crank 11 is engaged;
b. The friction shoe bridle or forked arm 16 which is pivotally attached to the sleeve 13 by pin 9;
c. The drive pin 17 which is attached to the forked arm 16 for selective engagement with the shaft 6;
d. The clutch engaging spring 18 which acts between the sleeve 13 and the lever 16 to hold the drive pin 17 against the side of the shaft 6.

All clutches have a driving member and a driven member which can be selectively engaged with one another. In this case, the side of the shaft 6 is the driven member and the drive pin 17, lever 16 and sleeve 13 constitute the driving member.

Figure 4:
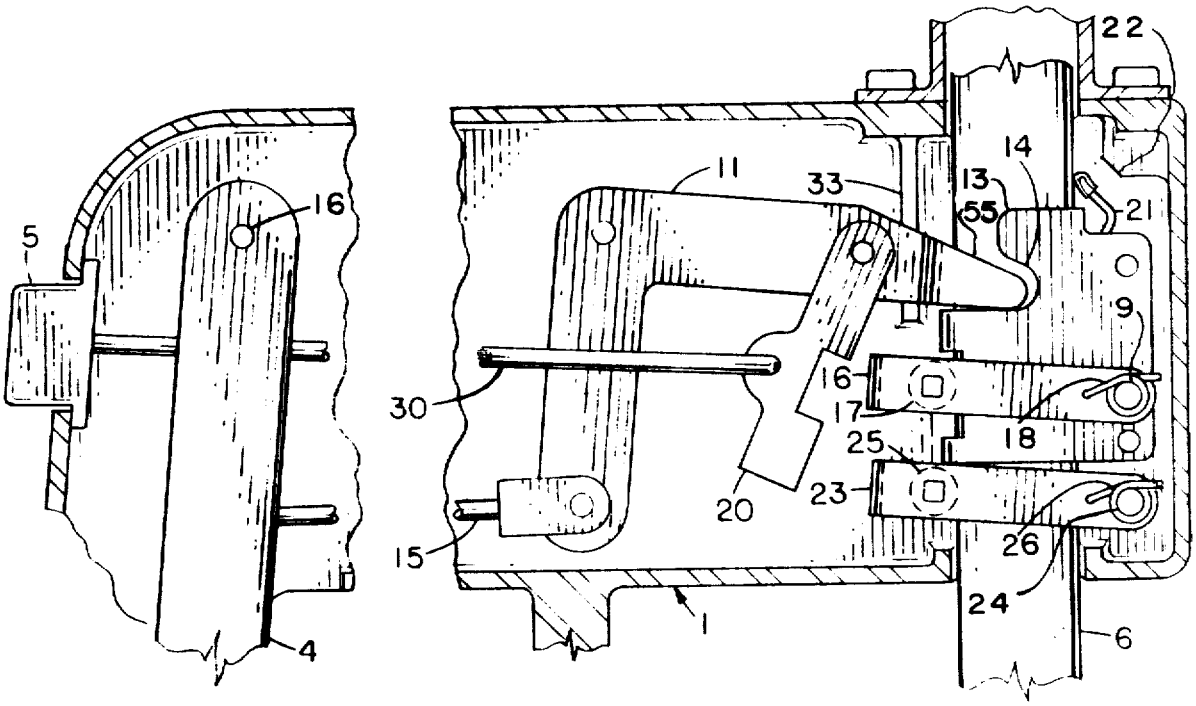
Figure 5:
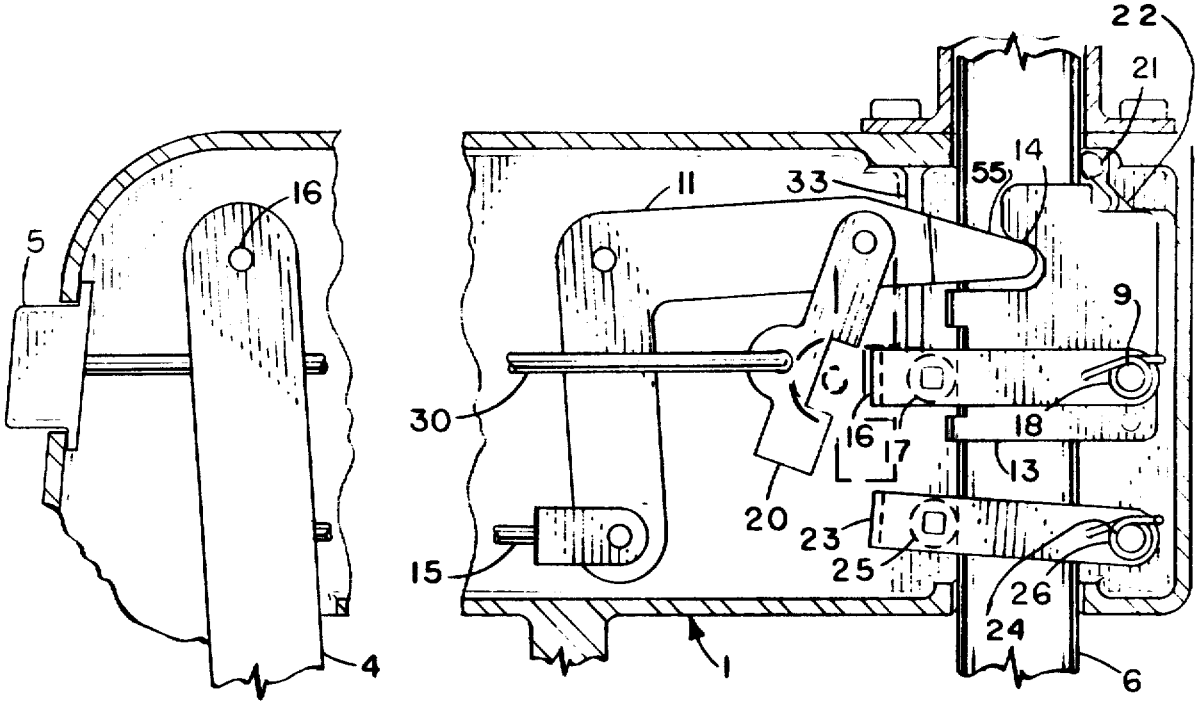
FIG. 5 is a cutaway view similar to FIGS. 3 and 4 but with the hand squeeze lever released and the drive clutch released by a fixed stop.
Figure 6:
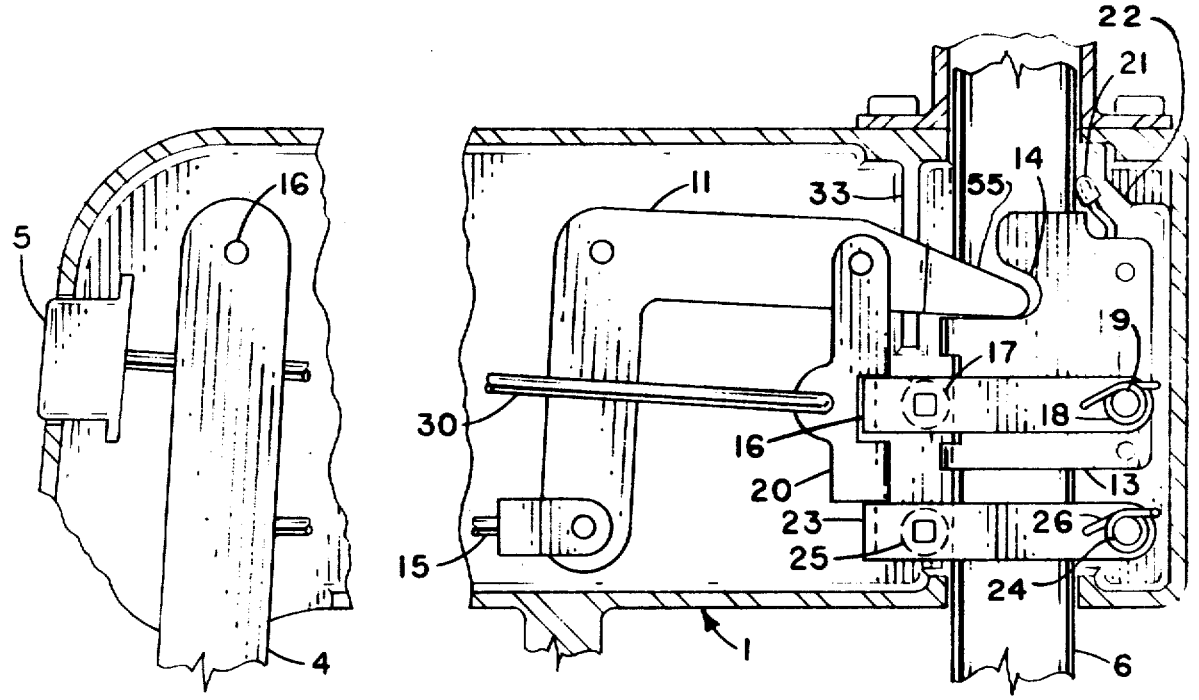
FIG. 6 is a cutaway view with both clutches released.
Figure 7:
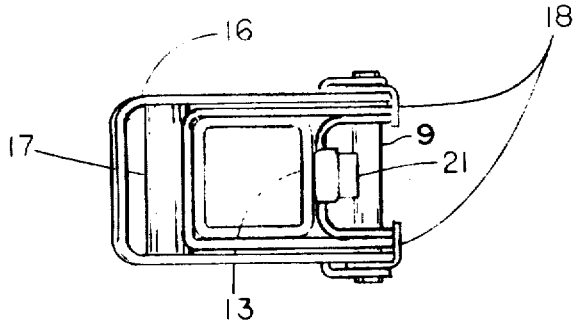
FIG. 7 is a plan view of the one-way clutch used to advance or drive the work holding jaw shaft.
Figure 8:
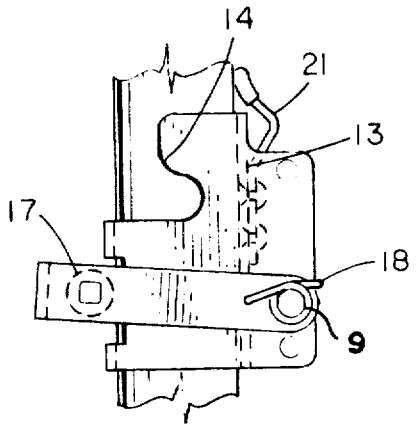
FIG. 8 is an elevation of the clutch of FIG. 7.
Figure 9:
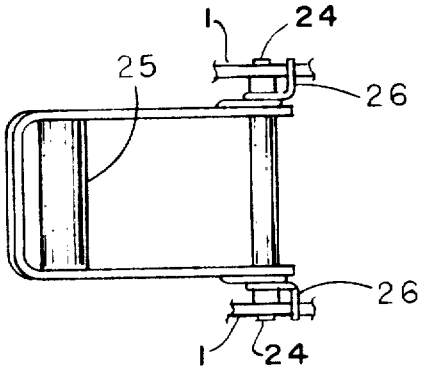
FIG. 9 is a plan view of the one-way clutch used to hold the shaft position as the shaft advancing clutch is returned for another drive stroke.
Figure 14:
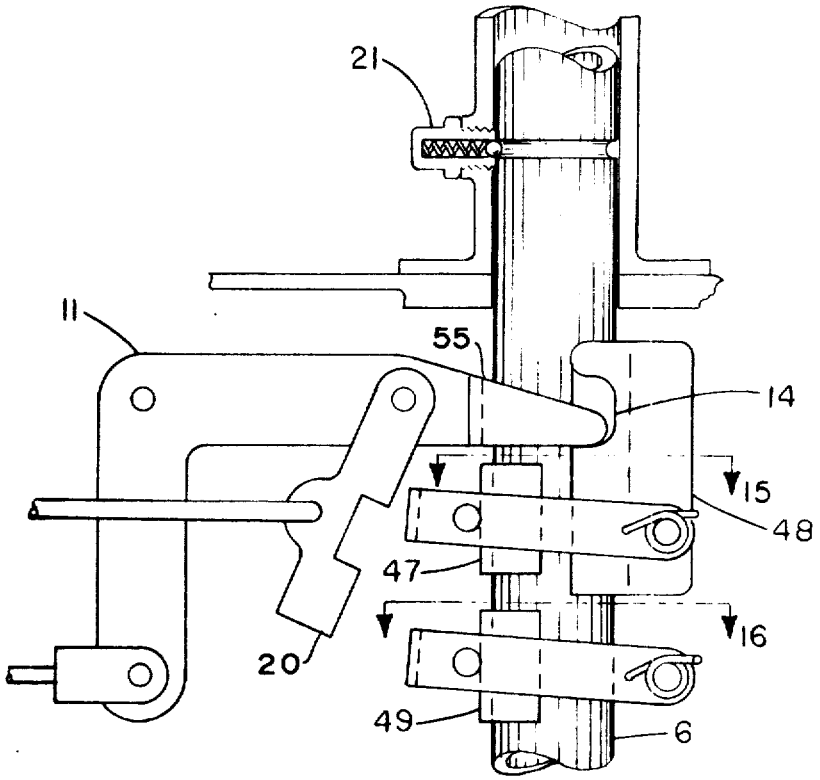
FIG. 14 is a cutaway view of an adaptation of the clutches to a round shaft with FIGS. 15 and 16 being sectional views on the lines 15—15 and 16—16 of FIG. 14 with the crank not shown.

The drive clutch 13 can be raised and lowered on the shaft 6 from a top position as seen in FIG. 5 to a bottom position as seen in FIG. 4. A spring detent 21 is attached to sleeve 13 of the one-way clutch 9 for cooperation with stop or abutment 22 in the clamp body 1 to hold the shaft 6 in an open position when desired. An alternate form of detent 21 shown in FIG. 14 is a simple ball detent in the shaft cap 29 which engages an annular groove in the shaft 6. An alternate construction would place the ball detent in the shaft 6 engaging an annular groove in the wall of the cap 29.

Shaft Holding Clutch

A shaft holding one-way clutch is seen in FIGS. 2-6, 9, 14, and 16. This second clutch consists of the following:

a. A forked arm 23 pivotally attached to the clamp housing 1 by pivots 24;
b. A shaft holding pin 25 being attached to the forked arm 23 for selective engagement with the shaft 6;
c. The clutch engaging spring 26 which acts between the clamp housing 1 and the forked arm 23 to hold the pin 25 against the side of the shaft 6; and In this case the driven member of the clutch is the side of shaft 6 and the driving member is the drive pin 25 and arm 23.

One-way Clutch Principle

Figure 3:
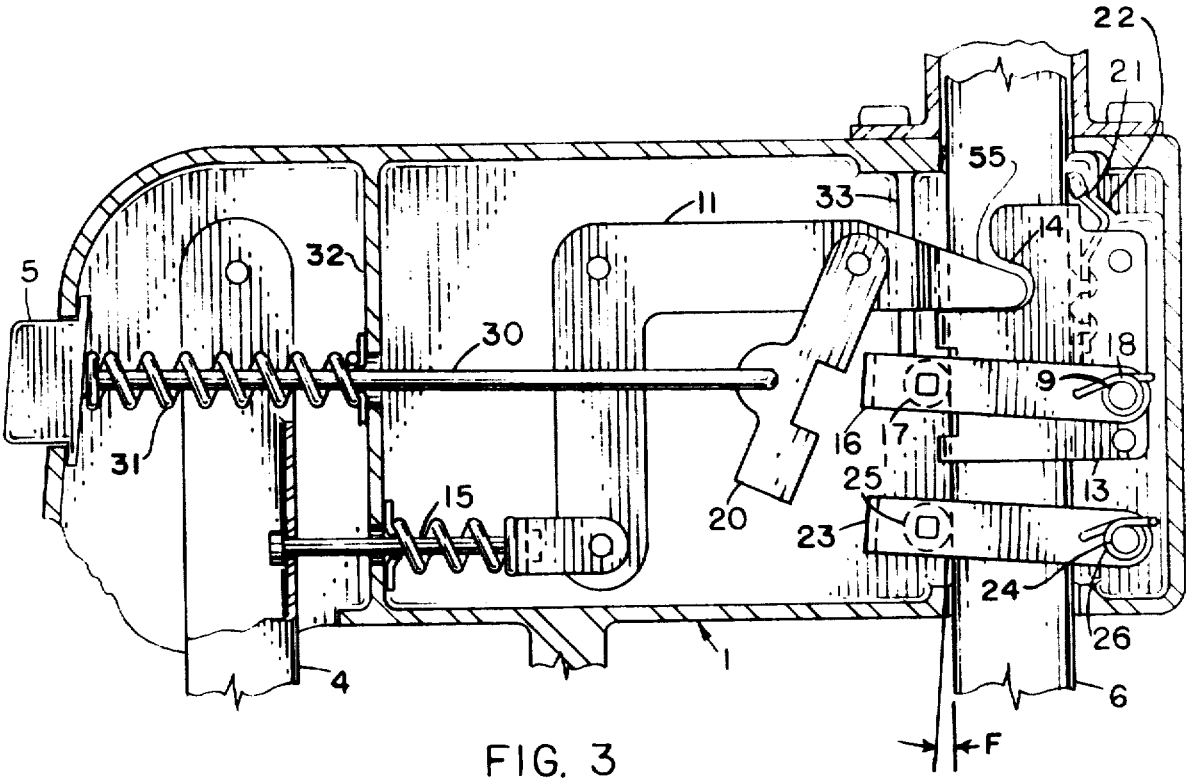
FIG. 3 is a cutwaway view of an elevation of a portion of the clamp of FIGS. 1 and 2 showing the parts in position at the beginning of the drive stroke, and FIG. 4 showing the parts at the end of a drive stroke.

In the drive clutch 13 and the holding clutch 23, the angle F as seen in FIG. 3 between the side of the shaft 6 and a normal or perpendicular line to the longitudinal axis of the forked arm 16 or 23 is less than the angle of friction for the pin to the shaft so that any force tending to retract the shaft 6 and thus cause sliding of the pin on the side of the shaft 6 will generate additional holding force to firmly engage pin 17 or 25 with the shaft 6. The force of the shaft extension or clamp closing spring 28 in shaft cap 29 urging extension of the shaft 6, however, will merely serve to disengage both clutches by swinging the forked arms 16 and 23 to raise the pins 17 and 25 from binding on the surface of the shaft 6.

Clutch Release Mechanism

The clutch release mechanism is used to allow opening of the clamp by retracting the shaft 6 into the shaft cap 29. The clutch release mechanism consists of the following:

a. The clutch release cam arm 20 which is pivotally attached to the bell crank 11;
b. A push rod 30 connecting the cam arm 20 with the clutch release push button 5;
c. A compression spring 31 on the push rod 30 acting between the clutch release button 5 and an interior wall 32 of the clamp housing 1 to extend the push button and retract the cam arm 20; and
d. A drive clutch trip bracket 33 on the wall of the clamp housing 1.

Method of operation of the Clamp

1. Initial Closing

Figure 10:
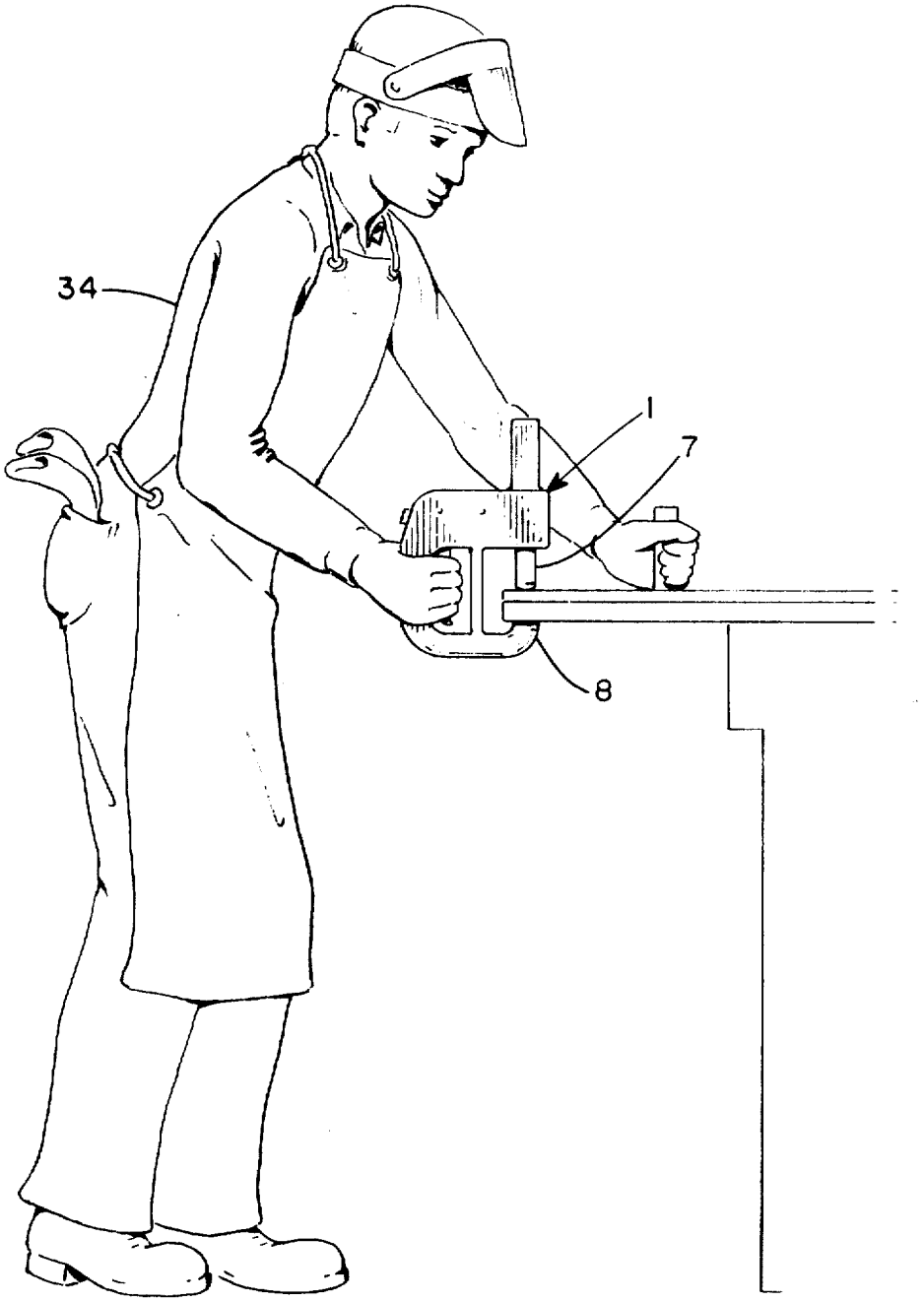
FIG. 10 is a side elevation of a welder using the one-hand operating C-clamp of FIGS. 1 through 9.

When the clamp is open as shown in FIGS. 2 and 5, the shaft 6 is held in a retracted position by the spring detent 21 acting in conjunction with the stop or abutment 22 against the force of the shaft extension spring 28. The one-way clutch 13 is disengaged by the drive clutch trip bracket 33. As seen in FIG. 10, with one hand holding the work, the operator 34 holding the open clamp in his other hand slips the clamp over the work to the position desired to apply a clamping force. Using his hand which holds the clamp, the operator 34 then squeezes the hand lever 4 and hand grip 2 which causes the bell crank 11 to push down on the drive clutch 13 thus releasing it and the shaft 6 from the detent spring 21 and allowing the drive clutch forked arm 16 to swing up with the pin 17 against the shaft 6. With the shaft 6 released from the spring detent 21, the shaft extension spring 28 lowers the shaft 6 and work holding jaw 7 to the work. The speed of the shaft extension is limited by the dashpot action provided by a small orifice 35 in the shaft cap 29 thus allowing the operator to insure accurate placement of the clamp on the work. Because the one-way clutch engaging springs 18 and 26 raise the forked arms 16 and 23, holding the clutch pins 17 and 25 against the shaft 6, as the shaft extends, the friction between the clutch pins 17 and 25 and the shaft 6 tends to lift the pins 17 and 25 off the shaft 6.

2. Application of Clamping Force

The shaft extension spring 28 exerts only a gentle clamping force on the shaft 6. In order to apply additional clamping force, the operator, having lowered the moveable work holding jaw to the work with the extension spring 28, successively exerts a gripping force with his clamp holding hand drawing the hand squeeze lever 4 towards the hand grip 2 of the clamp and releasing his grip allowing the crank return compression spring 12 to swing the hand squeeze lever 4 away from the hand grip 2. On each grip or hand squeeze stroke of the operator's hand the bell-crank 11 is rotated clockwise as shown in FIGS. 2–6 and 14. When it so rotates, the bell-crank 11 pushes down on the drive clutch sleeve 13. Because of the friction angle F as noted above, the forked arm 16 of the drive clutch causes the drive pin 17 to firmly grip the side of shaft 6. Thus shaft 6 and the one-way drive clutch 13 are forced down together as a unit by the bell-crank 11. Although not shown to scale, the leverage of the drive will provide a shaft extension of about ⅛ inch (0.3 cm.) per stroke of about 3 inches (7.6 cm.) of the hand squeeze lever 4. As the shaft 6 is extended in this manner, the friction between the pin 25 of the one-way holding clutch 23 and the shaft 6 tends to lift the pin off the shaft 6 and the holding clutch 23 thus does not resist extension of the shaft 6.

3. Clamp Holding Action

At the end of each drive stroke as seen in FIG. 4 as the bell-crank 11 reverses direction to raise the one-way drive clutch 13 with a counter-clockwise rotation of the bell-crank 11, the clamping force tending to open the clamp by retracting the shaft 6 exerts a friction force between the pin 25 of the holding clutch 23 and the shaft 6 to hold the shaft 6 from slipping upwards. As the one-way drive clutch 13 is raised for a successive drive stroke, the friction between drive pin 17 and the shaft 6 tends to lift the pin 17 off the shaft 6 so that the drive clutch can be freely raised. Thus the shaft 6 can be successively extended until the desired clamping force has been exerted. The operator 34 can then remove his hand from the clamp, the hand squeeze lever will be in the released position, the one-way drive clutch 13 will be raised for another drive stroke as in FIG. 5, and the clamp will be held tight by the one-way holding clutch 23. It the one-way drive clutch 13 is stopped at any position of the drive stroke by relaxing the operator's grip on the hand squeeze lever 4, the one-way holding clutch 23 will prevent the shaft from retracting thus retaining the clamping force at that point. It is therefore possible to obtain the required clamping force by moving the moveable clamp jaw 7 for any amount more or less than a full stroke, the action being infinitely variable.

4. Clamp Release Action

When the operator wishes to release the clamp, he again grasps the clamp with the palm and fingers of one hand encircling the hand grip 2 and the hand-squeeze lever 4. He then presses the clutch release button 5 with his thumb which swings the clutch release cam arm 20 in a counter-clockwise direction as seen in phantom in FIG. 5 to engage arm 16 in the notch of arm 20. With his thumb continuing to press button 5, he then squeezes lever 4 towards grip 2 to lower drive clutch 13 and arm 20 so that the bottom of arm 20 strikes arm 23 and swing holding clutch pin 25 free of shaft 6. This also disengages the detent 21. The operator then presses down on the clamp with the hand holding it, forcing the shaft 6 against the work to retract the shaft 6 against the light force of the shaft extension spring 28 to open the clamp. When the operator 34 releases the hand lever 4, the crank 11 is rotated counter-clockwise by the crank return spring 12 setting the detent 21 against the shaft 6 at whatever position the operator 34 has elected by releasing the hand lever 4.

VARIATIONS OF THE INVENTION

Figure 11:
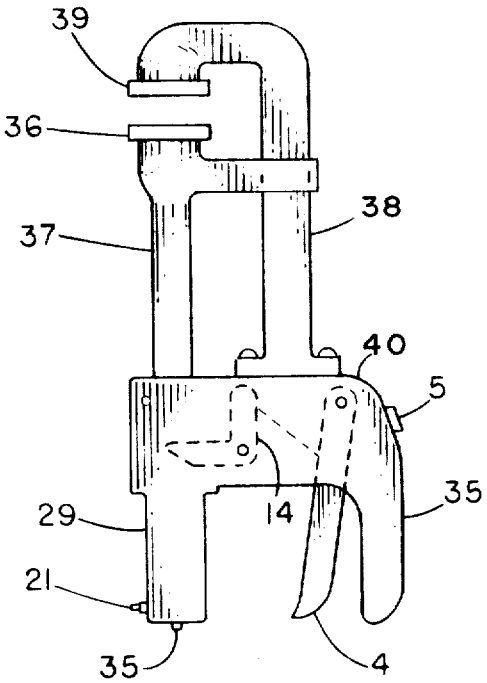
FIGS. 11–13 and 17 are side elevations respectively of a pipe wrench, a bench mounted clamp, a bench vise and a pruning shear using the principle of my invention.
Figure 12:
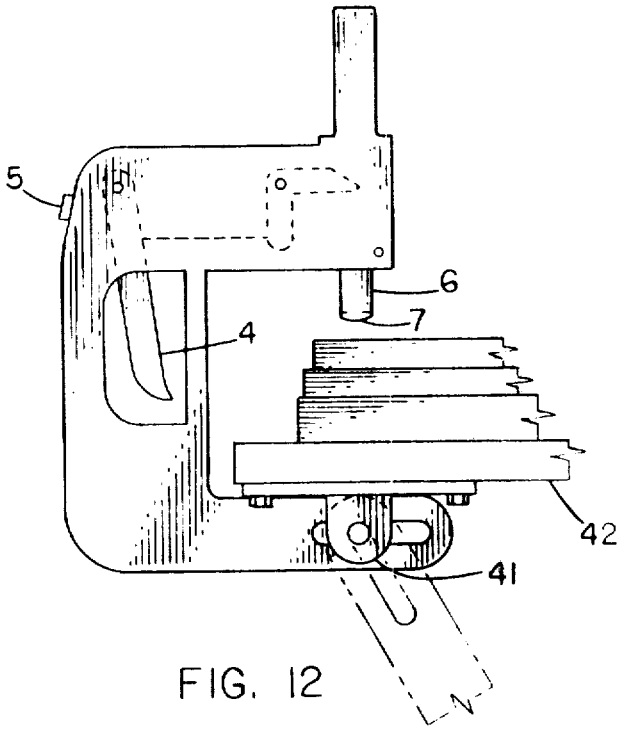
Figure 13:
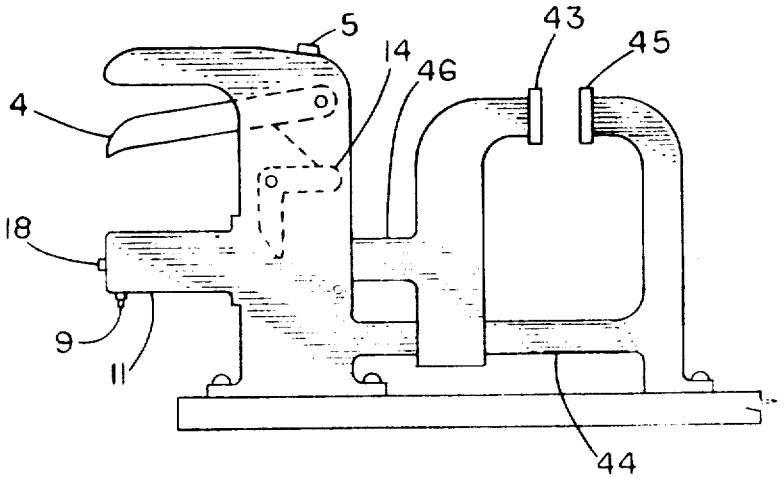

Among variations of the principle of this invention are the pipe wrench of FIG. 11, the bench-mounted clamp of FIG. 12 and the vise of FIG. 13. In the pipe wrench, the moveable jaw 36 is mounted on extension shaft 37 which is guided on strut 38 which attaches the fixed jaw 39 to the wrench housing 40. The clamp closing mechanism, manually operated shaft advancing mechanism and clutch release mechanism are essentially similar to those shown in the clamp of FIGS. 1 through 10 with the crank 14 reversed as shown in dashed lines. With this pipe wrench, the plumber is able to tighten and manipulate the wrench with one hand while holding the pipe or steadying himself with the other hand. Operation of the wrench is similar to that of the clamp.

The bench-mounted clamp of FIG. 12 differs from the basic clamp of FIGS. 1 through 10 only in that the housing 40 may be attached at pivot 41 to bench top 42 with the bench top 42 thus becoming the fixed work holding jaw. In using this clamp, after depressing the push button 5 and squeezing the hand lever 4, the shaft 6 is retracted by prying up with the work against the bench top 42.

The vise of FIG. 13 is an adaptation of the principle of this invention which allows the user to hold material in the vise with one hand, operate the controls to quickly close the moving jaw 43 against the work, applying clamping pressure with successive strokes of the hand lever 4, and later releasing the work from the vise using one hand to hold the work and one to operate the vise controls. The vise is constructed in much the same manner as the pipe wrench of FIG. 11 with the crank 14 reversed as shown in dashed lines, the moveable jaw 43 being moved towards and away from the fixed jaw 45 by the shaft 46.

Figure 16:
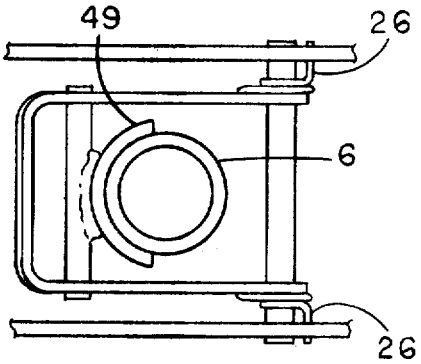
Figure 15:
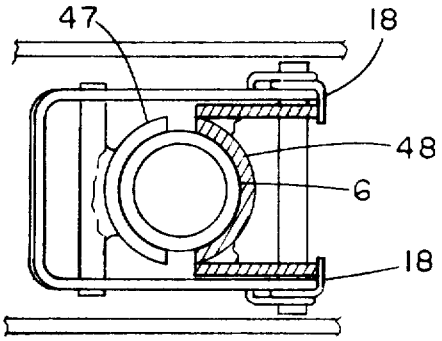

The one-way clutches of FIGS. 14–16 are similar to the one-way clutches of the clamp of FIGS. 1 through 10 except that semi-cylindrical shoes 47 and 48 take the place of the sleeve 13 and the sleeves 47 and 49 are in contact with the shaft 6 rather than the pins 23 and 26 directly.

Figure 17:
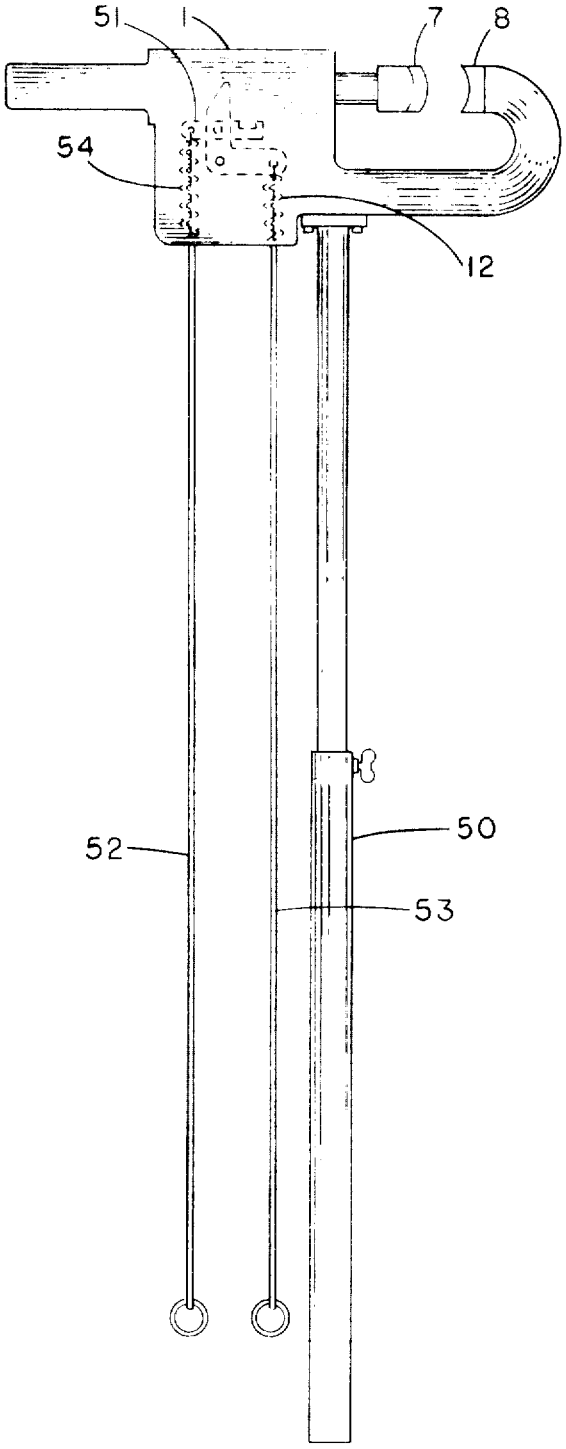

In another adaptation of my invention as a lightweight powerful pruning shear, as seen in FIG. 17, the housing 1 for the clamping mechanism is mounted on an extendible arm 50. Both the moveable work holding head 7 and the fixed work holding head 8 are in the form of sharp blades. The clutch release notched arm 51 is extended so as to be operable by a pull rope 52 to serve in place of the push button 5, and a pull rope 53 is used in place of the hand squeeze lever 4 to draw the two blades 7 and 8 together for shearing action. The compression spring 54 acting against the extended notched arm 51 normally holds the notched arm 51 out of engagement with the two clutches. In operation, the arm 50 is extended to the desired length to reach the branch to be severed, the clamping mechanism housing 1 is raised so as to place the fixed head 8 against the branch to be severed, the rope 53 is pulled once to bring the moveable blade 7 against the opposite side of the branch, and a succession of pulls on rope 53 will draw the two blades 7 and 8 together to sever the branch. If the operator wishes to stop the cutting action at any point, he may pull on rope 52, then rope 53 to disengage both clutches. A slight push of the clamp housing 1 forcing the blade 7 against the branch will retract the moveable blade 7, and the pruning shear should then be free of the branch. Retraction of the moveable head 7 after severing the branch can be accomplished in similar fashion by first lowering the head 1 into the operator's hands, pulling on rope 52 and then on rope 53 to disengage the clutches and then retracting the moveable head 7 by hand.

I claim:

1. In an adjustable clamp having a C-shaped frame, a hand grip for holding the clamp, a spring-biased hand squeeze lever adjacent to the hand grip, a fixed work holding head on one arm of the frame facing the other arm and a moveable work holding head on the end of a shaft facing the fixed work holding head, said shaft being slidably mounted in a bore of the other arm of the frame for movement of the moveable work holding head towards and away from the fixed work holding head; a clamp adjusting mechanism comprising:

a. A shaft detent means operably supported by the clamp and selectively engaged with the shaft whereby the moveable work holding head may be held at a desired distance from the fixed work holding head;

b. A shaft biasing means operably connected to the shaft so as to urge the shaft towards the fixed work holding head;

c. A first one-way clutch comprised of a driving member and a driven member wherein the driven member is operably connected to the shaft and the driving member is operably connected to the frame whereby motion of the driven member in the free-running direction of the clutch will allow the shaft to advance the moveable work holding head towards the fixed work holding head and motion of the driven member in the locking direction of the clutch will be opposed thereby opposing motion of the moveable work holding head away from the fixed work holding head;

d. A second one-way clutch comprised of a driving member and a driven member wherein the driven member is operably connected to the shaft and the driving member is operably connected to the hand squeeze lever whereby motion of the driving member in the free-running direction of the clutch will allow the hand squeeze lever to be returned from a drive stroke by the spring bias and motion of the driving member of the clutch in the locking direction of the clutch will advance the moveable work holding head towards the fixed work holding head whereby when the clamp is open with the fixed working holding head held against the work, the first squeeze of the hand about the hand squeeze lever and the hand grip with release the shaft from the detent, allowing the biasing means to advance the moveable work holding head against the work, relaxing the grip will return the driving member of the second one-way clutch for another shaft advancing stroke, and subsequent reciprocatory movement of the hand squeeze lever will advance the moveable work holding head against the work to increase the clamping force of the fixed and moveable work holding heads on the work;

e. A clutch release means comprising a push button operably supported in the hand grip so as to be operable by the thumb of the hand gripping the clamp, said push button being spring biased to extend out from the grip and a means operably connected to the push button and selectively engaged with the driving means of both clutches whereby when the push button is pressed, both clutches may be disengaged thus allowing retraction of the shaft against the shaft biasing means to open the distance between the work contacting heads;

whereby the clamp can be held and controlled by one hand to be easily slipped over the work in clamp open position, closed on the work with one squeeze of the hand holding the clamp, the work clamped with the desired clamping force by successive squeezes of the hand holding the clamp, the hand removed leaving the clamp in place for the desired time interval, and the clamp released by one hand holding the clamp.

2. A clamp as claimed in claim 1 wherein the shaft detent means comprises a spring detent operably attached to the frame adjacent to the shaft and a mating detent-engaging socket in the shaft.

3. A clamp as claimed in claim 1 wherein the shaft detent means comprises a spring detent operably attached to the shaft and a mating socket in the frame.

4. A clamp as claimed in claim 1 wherein the shaft detent means comprises a shaft engaging member operably connected to the driving member of the second one-way clutch and a stop operably connected to the frame alongside the shaft at a position in which the shaft engaging member will be forced against the shaft when the driving member of the second one-way clutch nears the end of its return stroke whereby when the clutches have been released, the shaft retracted, and the hand squeeze lever released, the driving member of the second one-way clutch will move away from the fixed work holding head, carrying the shaft engaging member into position against the stop to force the shaft engaging member against the shaft to hold the shaft retracted.

5. A clamp as claimed in claim 1 wherein the clutch release means also comprises a stop operably connected to the frame so that as the shaft nears the end of its retraction stroke, the driving member of the second one-way clutch will be forced out of engagment with the driven member of the second one-way clutch by the stop and wherein the means operably connected to the push button is operably connected to the hand squeeze lever; whereby when the hand squeeze lever has been released, the driving member of the second one-way clutch in returning for a subsequent drive stroke will be released at the end of its return stroke, then as the clutch release button is pressed, the clutch engaging member will be placed in position to engage the release driving member of the second one-way clutch and to engage the driving member of the first one-way clutch as the hand squeeze lever is gripped and moved for a drive stroke, holding the second one-way clutch released and causing the clutch engaging members to release the first one-way clutch.

6. An adjustable clamp as claimed in claim 1 wherein the biasing means also comprises a dashpot whereby the shaft extension speed is controlled.

7. An adjustable clamp as claimed in claim 1 wherein the fixed work holding jaw comprises a work bench to which the clamp frame is operably attached.

8. A clamp as claimed in claim 1 wherein the driven member of the first one-way clutch comprises the side of the shaft and the driving member of the first one-way clutch comprises an arm disposed across and alongside the shaft pivotally connected to the frame near one end of the arm with a shaft engaging member operably connected to the arm so that as the arm swings about its pivot, the shaft engaging member will contact the opposite side of the shaft from the arm pivot the angle between the side of the shaft in contact with the shaft engaging member and a line normal to a line through the arm pivot and the effective center of contact of the shaft and shaft engaging member being less than the angle of friction of the shaft side and the shaft engaging member, and a spring bias acting between the frame and the arm to operably swing the arm so as to bring the shaft engaging member into contact with the shaft.

9. A clamp as claimed in claim 1 wherein the driven member of the second one-way clutch comprises the side of the shaft and the driving member of the second one-way clutch comprises a sleeve in sliding engagement with the shaft and surrounding same, an arm disposed across and alongside the shaft pivotally connected to the sleeve near one end of the arm with a shaft engaging member operably connected to the arm so that as the arm swings about its pivot, the shaft engaging member will contact the opposite side of the shaft from the arm pivot, the angle between the side of the shaft in contact with the shaft engaging member and a line normal to a line through the arm pivot and the effective center of contact of the shaft and shaft engaging member being less than the angle of friction of the shaft side and the shaft engaging member, and a spring bias acting between the sleeve and the arm to operably swing the arm so as to bring the shaft engaging member into contact with the shaft.

* * * * *